United States Patent [19]

Janssen

[11] 4,249,765

[45] Feb. 10, 1981

[54] ARRANGEMENT FOR HOLDING ROPES AND THE LIKE

[75] Inventor: Hans-Georg Janssen, Bremerhaven, Fed. Rep. of Germany

[73] Assignee: Aktiengesellschaft "Weser" Werft Bremen, Bremen, Fed. Rep. of Germany

[21] Appl. No.: 94,663

[22] Filed: Nov. 15, 1979

[30] Foreign Application Priority Data

Nov. 27, 1978 [DE] Fed. Rep. of Germany ..... 2851267

[51] Int. Cl.[3] ..... B63B 21/04

[52] U.S. Cl. ..... 294/84; 114/230; 294/83 R

[58] Field of Search ..... 294/84, 83 R, 66, 104, 294/75, 76, 88, 101; 114/230, 252; 24/115 R

[56] References Cited

U.S. PATENT DOCUMENTS

| | | | |
|---|---|---|---|
| 3,610,674 | 10/1971 | Janssen | 294/75 |
| 3,763,815 | 10/1973 | Hodate | 24/115 R |

*Primary Examiner*—James B. Marbert

*Attorney, Agent, or Firm*—Michael J. Striker

[57] ABSTRACT

An arrangement for holding a rope or the like has a support, a hook member supported by the support rotatably about an axis and formed as a double hook having two hook arms which are mirror-symmetrical relative to one another, and a releasable locking member arranged for locking the hook member in a holding position. The hook member may have a S-shaped contour in its side view in the direction of axis of rotation. Each hook arm may be provided with an abutment for the locking member, the abutment being arranged at an opposite side relative to a recess for receiving of the rope and the like. The abutment may be formed as a surface which has a cutout in a direction opposite to the direction of the rotation of the hook member.

8 Claims, 2 Drawing Figures

Fig.1
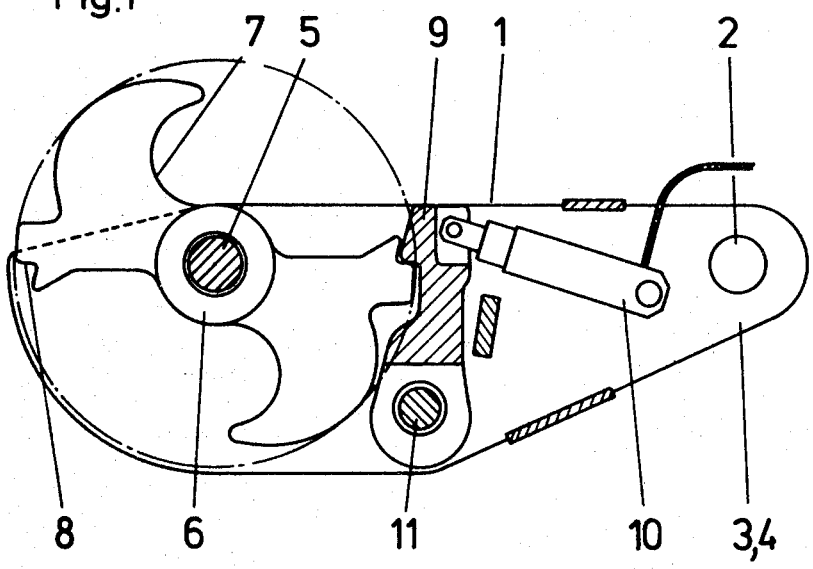
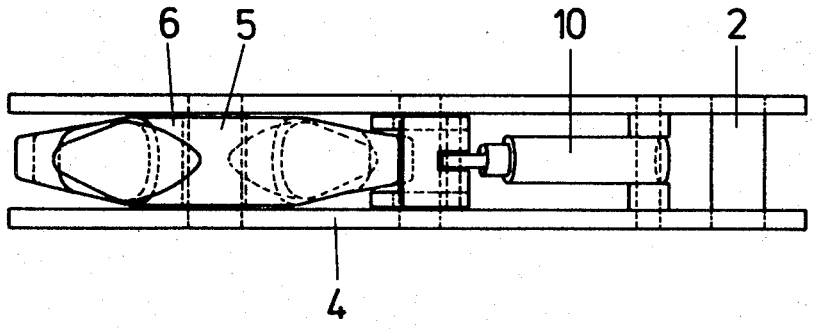
Fig. 2

ARRANGEMENT FOR HOLDING ROPES AND THE LIKE

BACKGROUND OF THE INVENTION

The present invention relates to an arrangement for holding ropes and the like. More particularly, it relates to an arrangement for holding ropes and the like, in which a hook member is supported rotatably about an axis and held in its holding position by a releasable locking element. Such an arrangement can be especially utilized in towing gear of towing ships. However, similar arrangements can also be utilized as mooring arrangements especially for big ships.

Arrangements of the above-mentioned general type are known in the art. For example, a holding arrangement is known in which a rope hook is supported tiltable about a horizontal axis in an anchored hook support or pedestal. The rope hook is held in the holding position for the rope by an arbitrary releasable locking member. This arrangement is disclosed in the German Pat. Nos. 1,063,054 and 1,119,174. Towing gear for towing ships is equipped with a circular disk-shaped hook member for holding a rope which is radially guided against the hook member. In order to receive the rope, the hook member is provided with a recess forming a hook throat and with an oppositely located notch which serves as an abutment for the locking member. When the locking member is released, such a hook member can rotate with a high number of revolutions. The disk forming the hook member is substantially solid so that the holding arrangement has a great weight. The holding position of the hook member after each release must be again set by rotation of the hook member manually so as to further arrest the locking member. This is disclosed in the German Pat. Nos. 1,083,147 and 1,142,518.

SUMMARY OF THE INVENTION

Accordingly, it is an object of the present invention to provide an arrangement for holding a rope and the like, which avoids the disadvantages of the prior art.

More particularly, it is an object of the present invention to provide an arrangement for holding a rope or the like, which has a smaller weight compared with known arrangements and provides for automatic return of a holding member to a holding position after releasing of the holding arrangement.

In keeping with these objects and with others which will become apparent hereinafter, one feature of the present invention resides, briefly stated, in an arrangement in which a hook member is formed as a double hook including two hook arms which are mirror-symmetrical relative to an axis of rotation of the hook member.

When the arrangement for holding a rope or the like is designed in accordance with the present invention, the hook member has mass which is rotation symmetrically compensated, so that the hook member after release of the working member in the case of slipping of the rope under load can rotate with a high number of revolutions. This desirable action is provided in a hook member whose weight is substantially smaller than a disk-shaped hook member of the known arrangements.

In accordance with another advantageous feature of the present invention, the hook member has in its side view or a view in the direction of the axis of rotation, an S-shaped contour, and each hook arm of the hook member is provided with an abutment for the locking member. The locking member can be properly shaped and correspond to the locking members of the known arrangements. Advantageously, the locking member is actuated hydraulically which is known per se in the art.

In accordance with a further advantageous feature of the present arrangement, the abutment for the locking member in each hook arm is provided at a rear or trailing end which is opposite to a hook recess. Advantageously, the abutment for the locking member is formed as a surface which is provided with a cutout in a direction opposite to the direction of rotation of the hook member. Since the hook member is formed as a mirror-symmetrical double hook and provided with abutments which are cut out in the direction opposite to the direction of rotation, the locking member after releasing returns to its locking position. Thereby, the holding member automatically returns to its holding position in which one of the hook arms is available for receiving a rope or the like.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a view showing a longitudinal section of an arrangement for holding ropes or the like, in accordance with the present invention; and FIG. 2 is a plan view of the arrangement shown in FIG. 1.

DESCRIPTION OF A PREFERRED EMBODIMENT

A holding arrangement in accordance with the present invention, which is shown in FIG. 1, has a hook support or pedestal, which can be anchored on board of a ship, on a mooring post, a pier or the like in dependence upon its intended functions.

The hook support 1 has two lateral walls 3 and 4. A hook member 6 is supported between the lateral walls 3 and is freely rotatable about a horizontal axis. The hook member 6 is a two-arm member and includes two arm portions which are mirror-symmetrical relative to one another, as seen in FIG. 1, in the side view of the hook member or, in other words, in the axial direction. In this view the hook member 6 is S-shaped.

Each arm portion of the hook member 6 has a recess 7 suitable for receiving a rope or the like. The recesses 7 are provided in front or leading sections of the arm portions of the hook member 6, as considered in direction of rotation of the latter.

An abutment 8 for a locking member 9 is provided in each arm portion of the hook member 6. The abutment 8 of each arm portion is arranged opposite to the recess 7 of the same arm portion. In other words, the abutment 8 is provided in a rear or trailing portion of each arm of the hook member 6, as considered in direction of rotation of the latter. The abutment 8 is formed by a surface which extends radially to an axle 5 defining the axis of rotation of the hook member 6. This surface has a cutout in direction which is opposite to the direction of rotation of the hook member in the case of disengagement from the locking member 9. The locking member 9 interengage with the abutment 8 in holding position.

The locking member 9 is actuated by a hydraulically operated cylinder-and-piston unit 10. The cylinder-and-piston unit 10 is pivotally connected with one end portion of the locking member 9 and operative for displacing the latter.

The locking member 9 has another end portion which is pivotally connected with the hook support 1 for pivoting about an axis defined by an axle 11.

As can be clearly seen from FIG. 1, the lateral walls 3 and 4 have such a shape that they substantially cover all movable parts of the arrangement, in order to prevent damages because of mechanical interference.

The above-described arrangement is suitable for the utilization in a towing gear of towing ships. Without substantial modifications it also can be utilized in mooring arrangements.

It will be understood that each of the elements described above, or two or more together, may also find a useful application in other types of constructions differing from the types described above.

While the invention has been illustrated and described as embodied in a rope holding arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint or prior art, fairly constitute essential characteristics of the generic or specific aspects of this invention.

What is claimed as new and desired to be protected by Letters Patent is set forth in the appended claims.

I claim:

1. A holding arrangement for ropes and the like, comprising support means; a hook member supported by said support means and rotatable about an axis, said hook member is formed as a double hook having two hook arms which are mirror-symmetrical relative to one another; and releasable locking means arranged for locking said hook member in a holding position.

2. A holding arrangement as defined in claim 1, wherein said hook member is U-shaped as seen in the direction of said axis of rotation.

3. A holding arrangement as defined in claim 2, wherein said locking means includes a locking member, each of said hook arms having an abutment arranged to be engaged by said locking member.

4. A holding arrangement as defined in claim 3, wherein each of said hook arms has a portion with which a rope or the like engages.

5. A holding arrangement as defined in claim 4, wherein said portion of each of said hook arms is provided with a recess in which the rope and the like engages.

6. A holding arrangement as defined in claim 4, wherein said hook member is rotatable in a predetermined direction, said portion of each of said hook arms being a leading portion in the direction of rotation of said hook member.

7. A holding arrangement as defined in claim 6, wherein each of said hook arms of said hook member has a trailing portion in the direction of rotation of said hook member, said abutment being formed on said trailing portion of each of said hook arms.

8. A holding arrangement as defined in claim 3, wherein said hook member is rotatable in a predetermined direction, said abutment of each of said hook arms being formed by a surface which is cut out in a direction opposite to the direction of rotation of said hook member.

* * * * *